US007882647B2

(12) United States Patent
Ikemizu

(10) Patent No.: US 7,882,647 B2
(45) Date of Patent: Feb. 8, 2011

(54) DRYER

(75) Inventor: Mugihei Ikemizu, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 315 days.

(21) Appl. No.: 11/791,073

(22) PCT Filed: Oct. 21, 2005

(86) PCT No.: PCT/JP2005/019411

§ 371 (c)(1),
(2), (4) Date: May 18, 2007

(87) PCT Pub. No.: WO2006/054423

PCT Pub. Date: May 26, 2006

(65) Prior Publication Data

US 2008/0307667 A1 Dec. 18, 2008

(30) Foreign Application Priority Data

Nov. 18, 2004 (JP) ..... 2004-333881

(51) Int. Cl.
*F26B 11/02* (2006.01)

(52) U.S. Cl. ..... 34/524; 34/132; 34/72; 34/75

(58) Field of Classification Search ..... 34/72, 34/73, 74, 75, 77, 78, 597, 607, 134, 140, 34/132, 524
See application file for complete search history.

(56) References Cited

U.S. PATENT DOCUMENTS 2,706,346 A * 4/1955 Smith ..... 34/75
5,219,371 A * 6/1993 Shim et al. ..... 34/597
5,396,715 A * 3/1995 Smith ..... 34/261
6,772,535 B2 * 8/2004 Koslow ..... 34/380
2003/0224965 A1 12/2003 Conley et al.

FOREIGN PATENT DOCUMENTS

| | | | |
|---|---|---|---|
| JP | 5-74487 | A | 10/1993 |
| JP | 8-215489 | A | 8/1996 |
| JP | 10-244099 | A | 9/1998 |
| JP | 2001-259330 | A | 9/2001 |
| JP | 2001-276484 | A | 10/2001 |
| JP | 2002-113288 | A | 4/2002 |
| JP | 2004-8429 | A | 1/2004 |
| JP | 2004-129841 | A | 4/2004 |
| JP | 2004-215817 | A | 8/2004 |
| WO | WO-03/089710 | A1 | 10/2003 |
| WO | WO-03/102291 | A2 | 12/2003 |

* cited by examiner

*Primary Examiner*—Jiping Lu
(74) *Attorney, Agent, or Firm*—Birch, Stewart, Kolasch & Birch, LLP

(57) ABSTRACT

One type of dryer, namely a laundry dryer (1), comprises a water tank (20) and a drum (30). At the time of drying laundry, the interior of the drum (30) functions as a hermetically closed drying chamber (170). The air in the closed drying chamber (170) is sucked into a circulation duct (171) and heated by means of a heater (173) to a hot air before being blown into the closed drying chamber (170). The hot air having absorbed moisture from the laundry comes into contact with dehumidification water in a cooling chamber (174) within the circulation duct (171), thereby being dehumidified. The dehumidification water is sprayed by a mist generator (180). In the drying process, the mist generator (180) generates mist of metal ion water which has passed through an ion dissolving unit (100) and sprays the mist to the laundry.

11 Claims, 14 Drawing Sheets

DRYER

BACKGROUND OF THE INVENTION

1. Field of the Invention

The present invention relates to a dryer for drying spin-dried laundry or the like.

2. Description of the Related Art

When laundry is washed in a washer, it is common to add a treatment agent to water, in particular, rinsing water. Typical treatment agents are fabric-softening and starching agents. In addition, today, there is increasing need for antimicrobial treatment of laundry.

From the hygienic point of view, laundry is best dried by being aired in the sun. Today, however, as more women go out to work and as more families live separately from their parents', the number of households is increasing in which nobody is home during the day. Such households have no choice but to dry laundry by airing it indoors.

Today, an increasing number of households use dryers to dry laundry, but many do so just for a short while, rather than to the end, and then continue to dry it by airing it indoors.

Compared with laundry aired in the sun, laundry aired indoors is more prone to proliferation of bacteria and mold. This is particularly notable under conditions where it takes time for laundry to dry, for example at high humidity as in a rainy season and at cold temperature as in winter. Proliferation of bacteria and mold may go so far as to make laundry stink.

On the other hand, with the recent trend toward economizing, many households reuse after-bathing water in laundry washing. The trouble with this is that after-bathing water is infected with bacteria that have proliferated overnight. These bacteria adhere to laundry and further proliferate, causing the laundry to stink.

Hence, in households that routinely have no choice but to air laundry indoors or routinely reuse after-bathing water in laundry washing, there is much need for antibacterial treatment of fabric articles with a view to suppressing proliferation of bacteria and mold.

Nowadays, many clothes are previously treated by antibacterial-deodorizing or bacteriostatic treatment. It is, however, difficult to procure such products as all the fabric articles used in a household. Moreover, the effect of antibacterial-deodorizing treatment diminishes as products treated with it are washed repeatedly.

From here comes the idea of treating laundry by antibacterial treatment every time it is washed. For example, Patent Documents 1 and 2 listed below disclose washers wherein silver ions are added to washing water by applying a voltage between silver electrodes; Patent Document 3 listed below discloses a washer furnished with a silver elution cartridge from which silver ions are eluted as a result of a silver eluting material (e.g., silver sulphide) being reacted with hypochlorous acid present in tap water. In all these washers, laundry is dipped in water containing antibacterial metal ions so that the metal ions attach to the laundry, and thereby antibacterial treatment of the laundry is achieved.

Whereas most conventional dryers for drying laundry are equipped with a drying function alone, an increasing number of recent ones are equipped with a washing function as well. An example of such a washer-dryer is disclosed in Patent Document 4 listed below.

Patent Document 1: JP-A-H5-74487 (page 1, FIG. 1)

Patent Document 2: JP-A-2001-276484 (page 2, FIG. 1)

Patent Document 3: JP-A-2002-113288 (pages 4-6, FIGS. 1 and 2)

Patent Document 4: JP-A-2004-8429 (pages 4-9, FIGS. 1-12)

SUMMARY OF THE INVENTION

Problems to be Solved by the Invention

When laundry dipped in water (silver ion water) containing antibacterial metal ions, for example silver ions, is dried, from the silver ion water that has penetrated the laundry, water—its main component—evaporates, leaving behind the silver ions in the form of fine particles of metal silver or fine particles of crystals of silver compounds such as silver oxide on the surface of the laundry. Next time these substances make contact with moisture, silver ions elutes from their surface, starting to exert an antibacterial effect.

In a water solution, silver exists in the form of silver ions ($Ag^+$), which exert an antibacterial effect. As water containing silver ions evaporates, the silver ion concentration in the water increases, and eventually those silver ions form salts with anions in the water and deposit as solid silver compounds. Salts such as AgCl and AgOH are unstable and ready to decompose into $Ag_2O$ and Ag, which are generally almost insoluble. What is to be noted here is that, at its surface, a solid is unstable in terms of energy, is greatly different from its interior in both property and composition, and is prone to elution of its substance. Thus, presence of $Ag_2O$ and Ag on the surface of laundry causes elution of silver ions, and thus brings about an antibacterial effect.

Incidentally, in the absence of moisture, no silver ions are eluted from crystals of silver compounds. This, however, does not cause any problem because, in the absence of moisture, most bacteria die, and any subsisting bacteria do not proliferate so far as to stink.

One way to more effectively obtain the antibacterial effect of silver ions is to make it easier for silver ions to elute from the silver compounds left on the surface of laundry. And one way to make it easier for silver ions to elute is to increase the speed at which silver ion water evaporates. This is because increasing the evaporation speed of silver ion water hastens the deposition of crystals of silver compounds, making the produced crystals largely finer in particle size and richer in lattice defects. Since dissolution of crystals occurs at lattice defects, which abound on their surface, the smaller the particle size of crystals (the larger their surface area) and the richer they are in lattice defects, the more easily they dissolve.

One disadvantage with the washers disclosed in Patent Documents 1 to 3, according to which laundry is dipped in silver ion water, is that, since the drops of silver ion water that attach to the surface of laundry are large, it takes time for the silver ion water to evaporate, with the result that the produced crystals of silver compounds are large in particle size and poor in lattice defects. Since these silver compounds are poor in lattice defects, even when they make contact with moisture, silver ions do not easily elute. This makes it impossible to effectively obtain the antibacterial effect of silver ions.

Moreover, as long as laundry is simply dipped in silver ion water, water-repellent articles repel it, allowing almost no silver ion water to be left on their surface. Similar inconvenience is experienced with articles of not so far as water-repellent but hydrophobic fabrics such as synthetic fibers. Since such articles are little absorbent, even when dipped in silver ion water, they are not penetrated with a sufficient amount of silver ion water. As a result, the amount of silver compounds left on the surface of such articles, and hence the amount of silver ions obtained, may be too small to produce a satisfactory antibacterial effect.

An object of the present invention is, in antibacterial treatment of laundry with metal ions, to produce crystals of metal compounds small in particle size and rich in lattice defects with a view to achieving quicker elution of metal ions and thereby securely obtaining an antibacterial effect. Another object is to make it possible to deposit crystals of metal compounds evenly on the surface of laundry irrespective of it is water-repellent or not.

Means for Solving the Problem

To achieve the above objects, according to one aspect of the present invention, a dryer comprises: a drying chamber for accommodating an article-to-be-dried; heating means for heating air inside the drying chamber; eluting means for eluting metal ions into water; and feeding means for feeding the drying chamber with fine water drops of the water into which the metal ions are eluted. Here, the heating means heats the drying chamber, the feeding means feeds the fine water drops to the article-to-be-dried, and the fine water drops that have attached to the article-to-be-dried are evaporated with heat of the heated article-to-be-dried.

With this construction, silver ion water in the form of fine water drops attaches to the heated article-to-be-dried, and thus evaporates quickly. Accordingly, the crystals of metal compounds that are left on the surface of the article-to-be-dried are small in particle size and rich in lattice defects; thus, next time they make contact with moisture, metal ions are eluted quickly. Thus, it is possible to securely obtain the antibacterial effect of metal ions. The fine water drops of metal ion water that have attached to the surface of the article-to-be-dried evaporates before ever flocking to form large drops. Thus, even if the surface of the article-to-be-dried is water-repellent, it is unlikely that large drops of metal ion water that have flocked are repelled, and thus crystals of metal compounds can be left evenly on the surface of the article-to-be-dried. Moreover, since the metal ion water is in the form of fine water drops, how much of it attaches does not depend on the condition on the surface of the article-to-be-dried; equal amounts of metal ion water attaches to the article-to-be-dried irrespective of whether it is of a hydrophilic or hydrophobic fabric. Thus, increasing the metal ion concentration in the metal ion water does not cause an excessive amount of metal compounds to attach to an article-to-be-dried that is highly absorbent According to another aspect of the present invention, a dryer comprises: a drying chamber for accommodating an article-to-be-dried; heating means for heating air inside the drying chamber; eluting means for eluting metal ions into water; and feeding means for feeding the drying chamber with fine water drops of the water into which the metal ions are eluted. Here, the heating means heats the drying chamber, the feeding means feeds the fine water drops to the article-to-be-dried, and thereby crystals of metal compounds having lattice defects are produced on a surface of the article-to-be-dried.

With this construction, since silver ion water is fed in the form of fine water drops, it evaporates quickly, and thus the crystals of metal compounds that are left on the surface of the article-to-be-dried are small in particle size and rich in lattice defects. Thus, next time they make contact with moisture, metal ions are eluted quickly, making it possible to securely obtain the antibacterial effect of metal ions. The fine water drops of metal ion water that have attached to the surface of the article-to-be-dried evaporates before ever flocking to form large drops. Thus, even if the surface of the article-to-be-dried is water-repellent, it is unlikely that large drops of metal ion water that have flocked are repelled, and thus crystals of metal compounds can be left evenly on the surface of the article-to-be-dried. Moreover, since the metal ion water is in the form of fine water drops, how much of it attaches does not depend on the condition on the surface of the article-to-be-dried; equal amounts of metal ion water attaches to the article-to-be-dried irrespective of whether it is of a hydrophilic or hydrophobic fabric. Thus, increasing the metal ion concentration in the metal ion water does not cause an excessive amount of metal compounds to attach to an article-to-be-dried that is highly absorbent.

According to another aspect of the present invention, a dryer comprises: a drying chamber for accommodating an article-to-be-dried; driving means for rotating the drying chamber; heating means for heating air inside the drying chamber; eluting means for eluting metal ions into water; and feeding means for feeding the drying chamber with fine water drops of the water into which the metal ions are eluted. Here, the driving means rotates the drying chamber, the heating means heats the drying chamber, the feeding means feeds the fine water drops to the article-to-be-dried, and thereby crystals of metal compounds having lattice defects are produced on a surface of the article-to-be-dried.

With this construction, since metal ion water in the form of fine water drops is fed to the article-to-be-dried inside the rotating drying chamber, it evaporates quickly, and thus the crystals of metal compounds that are left on the surface of the article-to-be-dried are small in particle size and rich in lattice defects. Thus, next time they make contact with moisture, metal ions are eluted quickly, making it possible to securely obtain the antibacterial effect of metal ions. The fine water drops of metal ion water that have attached to the surface of the article-to-be-dried evaporates before ever flocking to form large drops. Thus, even if the surface of the article-to-be-dried is water-repellent, it is unlikely that large drops of metal ion water that have flocked are repelled, and thus crystals of metal compounds can be left evenly on the surface of the article-to-be-dried. Moreover, since the metal ion water is in the form of fine water drops, how much of it attaches does not depend on the condition on the surface of the article-to-be-dried; equal amounts of metal ion water attaches to the article-to-be-dried irrespective of whether it is of a hydrophilic or hydrophobic fabric. Thus, increasing the metal ion concentration in the metal ion water does not cause an excessive amount of metal compounds to attach to an article-to-be-dried that is highly absorbent.

According to another aspect of the present invention, a dryer comprises: a drying chamber for accommodating an article-to-be-dried; driving means for rotating the drying chamber; heating means for heating air inside the drying chamber; eluting means for eluting silver ions into water; and feeding means for feeding the drying chamber with fine water drops of the water into which the silver ions are eluted. Here, the driving means rotates the drying chamber, the heating means heats the drying chamber, the feeding means feeds the fine water drops to the article-to-be-dried, and thereby crystals of silver compounds having lattice defects are produced on a surface of the article-to-be-dried.

With this construction, since silver ion water in the form of fine water drops is fed to the article-to-be-dried inside the rotating drying chamber, it evaporates quickly, and thus the crystals of silver compounds that are left on the surface of the article-to-be-dried are small in particle size and rich in lattice defects. Thus, next time they make contact with moisture, silver ions are eluted quickly, making it possible to securely obtain the antibacterial effect of silver ions. The fine water drops of silver ion water that have attached to the surface of the article-to-be-dried evaporates before ever flocking to form large drops. Thus, even if the surface of the article-to-be-dried is water-repellent, it is unlikely that large drops of silver ion water that have flocked are repelled, and thus crystals of silver compounds can be left evenly on the surface of the article-to-be-dried. Moreover, since the silver ion water is in the form of fine water drops, how much of it attaches does not depend on the condition on the surface of the article-to-be-dried; equal amounts of silver ion water attaches to the article-to-be-dried irrespective of whether it is of a hydrophilic or hydrophobic fabric. Thus, increasing the silver ion concentration in the silver ion water does not cause an excessive amount of silver compounds to attach to an article-to-be-dried that is highly absorbent.

Preferably, there is additionally provided dehumidifying means for dehumidifying the air inside the drying chamber.

When the drying chamber is made air-tight, that is, when it is so constructed that no exchange of air is permitted with the outside, since the fine water drops containing metal ions is confined inside the drying chamber, it does not occur that the fine water drops containing metal ions leak out of the dryer without duly attaching to the article-to-be-dried. Thus, it is possible to make an effective use of the generated metal ions without wasting them. In addition, it does not occur that the fine water drops that have leaked out of the dryer causes current leakage in the dryer itself or in an electric appliance nearby or increases the humidity around to cause mold to form.

Moreover, when the door is closed, the dryer is almost completely air-tight. Thus, water remaining in the exhaust passage and elsewhere tends to keep the interior of the drum humid, possibly leading to proliferation of bacteria and mold. According to the present invention, the fine water drops containing metal ions spread around the drum and, in the case of a washer-dryer, around the tub and through the circulation passage and attach to their wall surfaces and the like. Thus, not only the article-to-be-dried but also almost the entire space inside the dryer is treated by antibacterial treatment so as to suppress proliferation of bacteria and mold there.

Preferably, the dehumidifying means achieves dehumidification by bringing the air inside the drying chamber into contact with dehumidification water, and the dehumidification water is sprayed by the feeding means.

With this construction, spraying the dehumidification water increases its surface area, and thereby improves the efficiency of heat exchange with the air to be dehumidified, resulting in an enhanced dehumidifying effect. Moreover, sharing the feeding means as spraying means helps simplify the construction.

Preferably, any of the driers constructed as described above further comprises one or both of: an outside air introducer for introducing outside air into the drying chamber; and an exhauster for exhausting the air inside the drying chamber.

With this construction, an open drying system is adopted in which outside air is introduced into the drying chamber and the air inside the drying chamber is exhausted. This offers good drying efficiency, and allows quick evaporation of the metal ion water in the form of fine water drops that has attached to the article-to-be-dried. Thus, it is possible to efficiently deposit crystals of metal compounds rich in lattice defects.

Preferably, generation of the fine water drops containing the metal ions and feeding of the fine water drops to the article-to-be-dried are performed in a latter half of a drying process and/or after completion of the drying process.

With this construction, the fine water drops containing the metal ions are sprayed on the article-to-be-dried that has been considerably or completely dried. At this stage, the article-to-be-dried is so hot that the fine water drops quickly evaporates. The higher evaporation speed here makes it possible to produce crystals of metal compounds that are smaller in particle size and richer in lattice defects.

Preferably, the feeding means is arranged in a position where it sprays the fine water drops directly on the article-to-be-dried.

With this construction, it is possible to attach the sprayed fine water drops efficiently to the laundry.

Preferably, the feeding means generates the fine water drops by exploiting the energy of an ultrasonic or sonic wave.

With this construction, it is possible to make the water drops extremely fine. This helps increase the evaporation speed of the fine water drops attached to the article-to-be-dried, and thus helps make the crystals of metal compounds left on it small in particle size and rich in lattice defects. Moreover, the fine water drops assimilate to air and thus tend to stay in the air for a long time; thus, their effect spreads over the article-to-be-dried and to all corners inside the dryer.

In a case where the metal ion water is made into a mist with a spraying nozzle such as the one used in an atomizer, to make the water drops finer, the nozzle aperture needs to be made smaller. Inconveniently, however, a small nozzle aperture is liable to be clogged with a deposit when high-concentration metal ion water is used, depending on the quality of water. The clogging of the nozzle aperture is also likely when the metal ion water contains a viscous treatment agent such as a softening agent. These inconveniences can be overcome when the fine water drops are generated without a nozzle aperture but instead by exploiting the energy of ultrasonic or sonic wave.

Advantages of the Invention

According to the present invention, a dryer comprises: a drying chamber for accommodating an article-to-be-dried; heating means for heating air inside the drying chamber; eluting means for eluting metal ions into water; and feeding means for feeding the drying chamber with fine water drops of the water into which the metal ions are eluted. The metal ion water in the form of fine water drops attaches to the article-to-be-dried, and evaporates quickly, leaving, on the surface of the article-to-be-dried, crystals of metal compounds that are small in particle size and rich in lattice defects. When these crystals of metal compounds make contact with moisture, metal ions are eluted quickly. Thus, it is possible to securely obtain the antibacterial effect of metal ions. The fine water drops of metal ion water that have attached to the surface of the article-to-be-dried evaporate before ever flocking to form large drops. Thus, it is possible to leave crystals of metal compounds evenly on the surface of the article-to-be-dried, irrespective of whether it is of a hydrophilic or hydrophobic fabric.

DETAILED DESCRIPTION OF THE INVENTION

A first embodiment of the present invention will be described below with reference to FIGS. 1 to 12.

Figure 1:
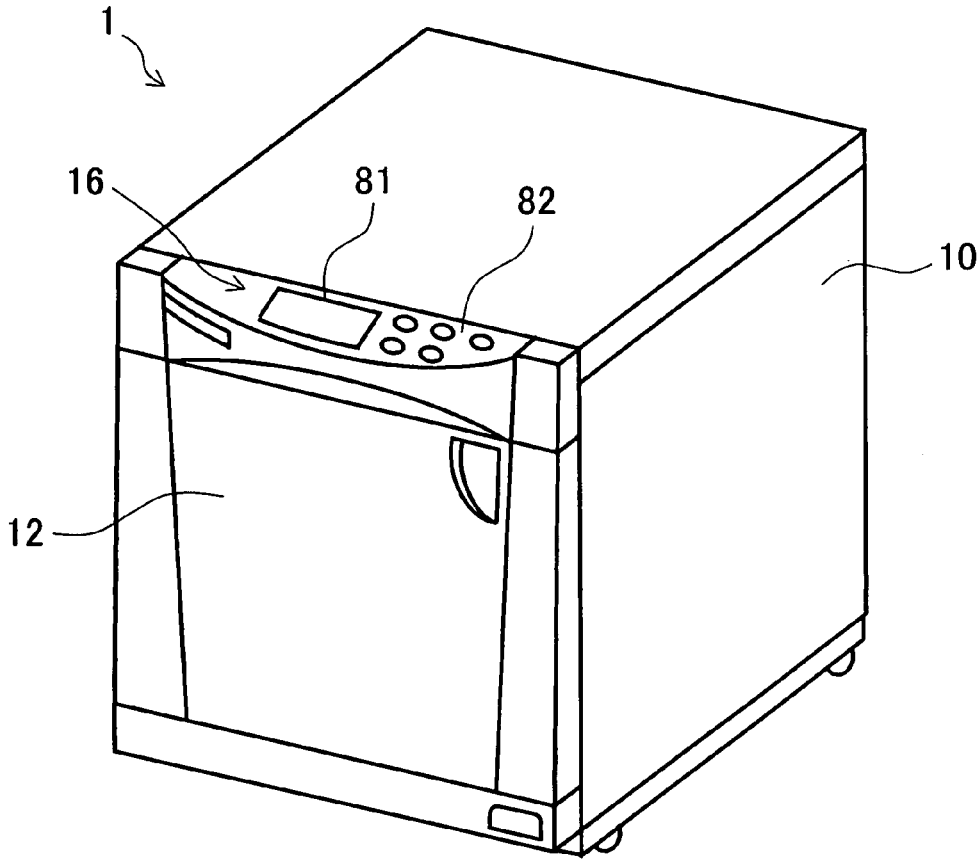
[FIG. 1] An exterior perspective view of a dryer according to a first embodiment of the present invention.
Figure 2:
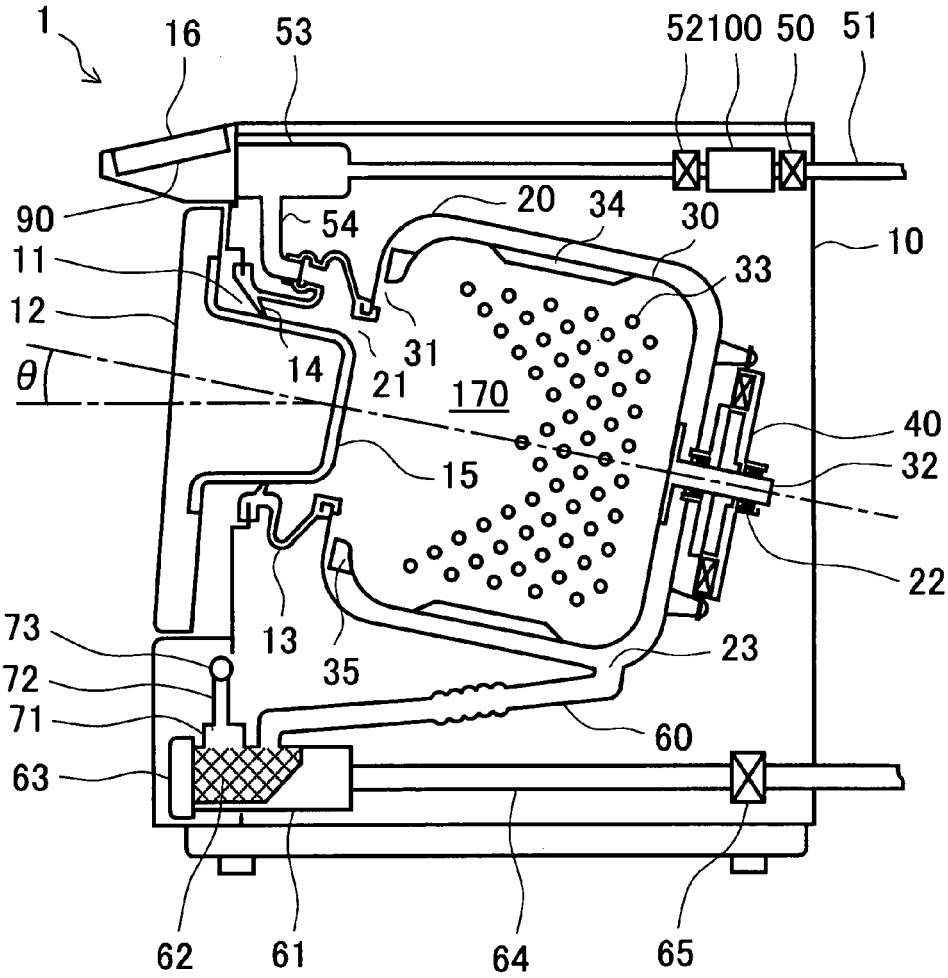
[FIG. 2] A vertical cross-sectional view of the dryer.
Figure 3:
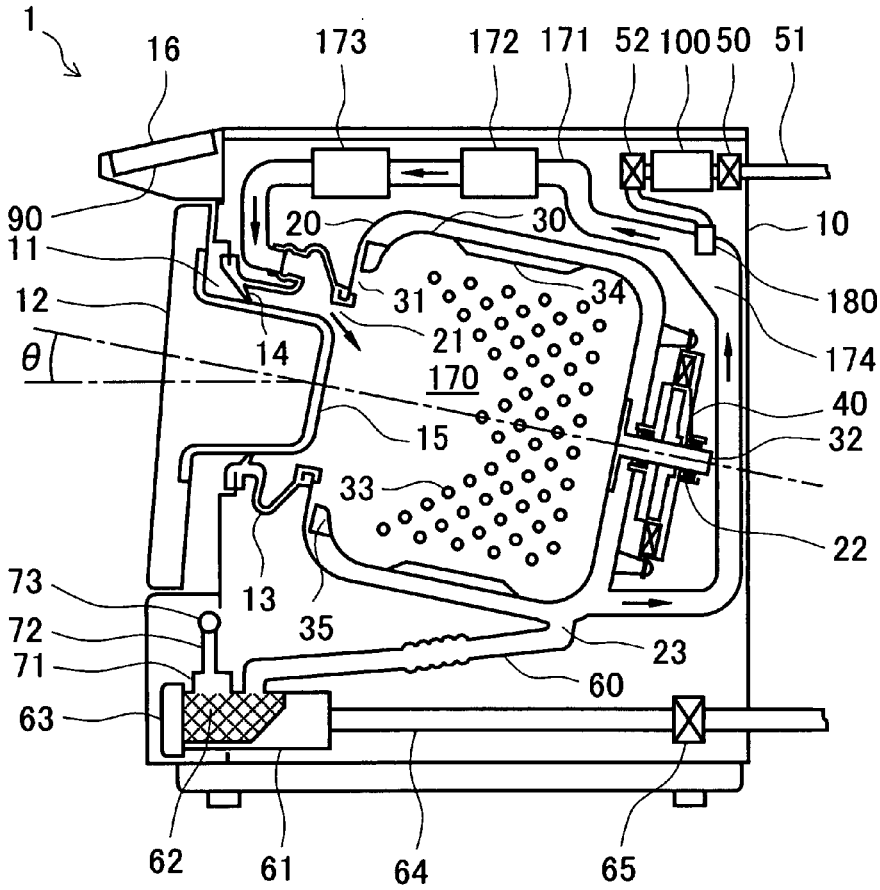
[FIG. 3] A vertical cross-sectional view of the dryer, along a different plane from FIG. 2.

According to the first embodiment, a dryer is built as a washer-dryer 1, of which an external perspective view is shown in FIG. 1, a vertical cross-sectional view is shown in FIG. 2, and a vertical cross-sectional view along a different plane from FIG. 2 is shown in FIG. 3. The plane of cross section of FIG. 2 is such that the water feed passage for washing and rinsing is visible; the plane of cross section of FIG. 3 is such that the air circulation passage for drying is visible.

The washer-dryer 1 has a box-shaped cabinet 10. Inside the cabinet 10 are arranged: a tub 20; and a drum 30 in which laundry is placed as an article-to-be-washed and an article-to-be-dried. The tub 20 and the drum 30 are both cylindrical in shape, and have laundry entrances 21 and 31 respectively.

From the center of the bottom of the drum 30, an axle 32 extends outward. The axle 32 is supported by a bearing 22 provided at the center of the bottom of the tub 20. Thus, the drum 30 and the tub 20 are arranged coaxially, with the drum 30 in and the tub 20 out.

The tub 20 and the drum 30 are supported, with their axial line running approximately horizontally, inside the cabinet 10 by an unillustrated suspension mechanism. In the first embodiment, the axial line of the tub 20 and the drum 30 is inclined at a predetermined angle θ (e.g., 15°) relative to the horizontal plane, with their laundry entrances 21 and 31 pointing slightly upward. This allows a better view into the drum 30, and facilitates placement and removal of laundry.

As described above, the rotation axis of the tub 20 and the drum 30 crosses the horizontal line, and the crossing angle here is assumed to be in the range from 0° to 30°; there is, however, no particular restriction on this range.

In the front outer wall of the cabinet 10, an opening 11 is formed to face the laundry entrances 21 and 31. At the front of the opening 11, a side-opening door 12 is provided. The opening 11 is coupled to the laundry entrance 21 by a door gasket 13 formed of soft synthetic resin or rubber. The door gasket 13 prevents the interior of the cabinet 10 from becoming wet with water splashed from inside the drum 30, water dripping from wet laundry during its placement and removal, water overflowing out through the laundry entrance 21, and the like.

Around the inner circumferential face of the door gasket 13, a ring-shaped lip 14 is formed integrally with it. The lip 14 makes intimate contact with the outer circumference of a protuberance 15 formed on the inner face of the door 12, so as to thereby prevent water leakage through the gap between the door gasket 13 and the door 12. The protuberance 15 prevents laundry in the drum 30 from getting out through the laundry entrance 21. The protuberance 15 may be formed of a transparent material to allow a view through it into the drum 30.

In the circumferential wall of the drum 30, a large number of water discharge holes 33 are formed. Through these water discharge holes 33, water moves between the drum 30 and the tub 20. On the inner circumferential face of the drum 30, a plurality of baffles 34 are provided at predetermined intervals. As the drum 30 rotates, the baffles 34 catches and lifts laundry to let it drop from above then.

On the outer face of the drum 30 and around its laundry entrance 31, balance weights 35 are fitted. In FIGS. 2 and 3, only the ring-shaped balance weight 35 fitted around the laundry entrance 31 is shown, and those fitted on the outer face of the drum 30 are omitted. The balance weights 35 suppress the vibration that arises when the drum 30 rotates at high speed.

On the outer face of the bottom of the tub 20, a motor 40 is fitted. The motor 40 is of a direct-drive type, and its rotor is coupled and fixed to the axle 32 of the drum 30. The bearing 22 mentioned previously is fitted to the housing of the motor 40, and thus constitutes part of the motor 40.

In a space over the tub 20, a source valve 50 is arranged that is opened and closed electromagnetically. To the source valve 50 is connected a feed hose 51 through which clean water such as tap water is supplied as a source of a mist containing metal ions, which will be described later. On the downstream side of the source valve 50, an ion elution unit 100 is connected and, further downstream, a triple feed valve 52 is connected. The feed valve 52 has one input port and three output ports, and can feed and stop water independently for the three output ports. Of the three output ports, the first feeds water to a detergent compartment (unillustrated) housed inside a container-shaped waterspout 53 arranged in a front part of the interior of the cabinet 10; the second feeds water to a treatment agent compartment (unillustrated) likewise housed inside the waterspout 53; the third feeds water to a mist generator 180. The mist generator 180 will be described later.

The waterspout 53 has, at the bottom thereof, a feed nozzle 54 that connects to a top part of the door gasket 13. Through the feed nozzle 54, the water that has passed through the detergent compartment, and also the water that has passed through the treatment agent compartment, is fed to the tub 20.

In a lowest part of the tub 20, a drain port 23 is provided, to which one end of a drain pipe 60 is connected. The other end of the drain pipe 60 is connected to a filter casing 61. In the filter casing 61 is inserted a lint filter 62. The lint filter 62 is formed of net or cloth of synthetic resin, and collects lint in water. At one end, the filter casing 61 is closed with a removable cap 63 so that, with the cap 63 removed, the lint filter 62 can be cleared or replaced.

To the filter casing 61 is connected a drain pipe 64 so that the drained water that has passed through the lint filter 62 is discharged out of the cabinet 10. Midway along the drain pipe 64, a drain valve 65 is provided.

Also connected to the filter casing 61 is an air trap 71. From the air trap 71, a lead pipe 72 extends, at the top end of which is provided a water level sensor 73. As the pressure inside the air trap 71 varies, the water level sensor 73 moves a magnetic member inside a coil. The water level sensor 73 detects the resulting variation in the inductance of the coil as the variation in oscillation frequency and, based on this variation in oscillation frequency, reads the water level. The water level read here is that inside the drum 30.

Laundry that has gone through washing, rinsing, and spin-drying is then dried inside the drum 30. The interior of the drum 30, and that of the tub 20 enclosing it, now serves as a hermetic drying chamber 170. That is, the laundry is dried not with air introduced from outside the washer-dryer 1 but with air circulated inside the washer-dryer 1.

To make such circulation drying possible, outside the tub 20, a circulation duct 171 is formed (see FIG. 3). One end of the circulation duct 171 is connected to the tub 20, near the drain port 23; the other end of the circulation duct 171 is connected to a top part of the door gasket 13. Midway along the circulation duct 171, a blower 172 and a heater 173 are provided. The blower 172 sucks the air inside the hermetic drying chamber 170 through the bottom of the tub 20, and then returns the sucked air to the hermetic drying chamber 170 through the top part of the door gasket 13. The heater 173 is disposed on the downstream side of the blower 172, and heats the air that is blown back into the hermetic drying chamber 170.

The air flowing through the circulation duct 171 is dehumidified by dehumidifying means. In this embodiment, the dehumidifying means is realized with a mist generator 180. The circulation duct 171 is given a larger passage cross-sectional area than elsewhere in its bent part where, having run upward from the bottom of the tub 20, it changes its direction toward the door gasket 13. This bent part of the circulation duct 171 serves as a cooling chamber 174, inside which the mist generator 180 is housed.

The mist generator 180 turns water into a fine mist by exploiting the energy of an ultrasonic or sonic wave. When used as dehumidifying means, however, the mist generator 180 may be so operated as to spray water in comparatively large drops. In that case, the water drops are given a size such that they flow into the tub 20 by falling under gravity without being sucked into the blower 172. The size needs to be set to suit the output of the blower 172, the diameter of the piping, etc., and therefore it is preferable to determine it through experiments.

As a source of the mist, the mist generator 180 receives the water that has passed through the ion elution unit 100. Now, with reference to FIGS. 4 and 5, the construction and function of the ion elution unit 100 will be described.

Figure 4:
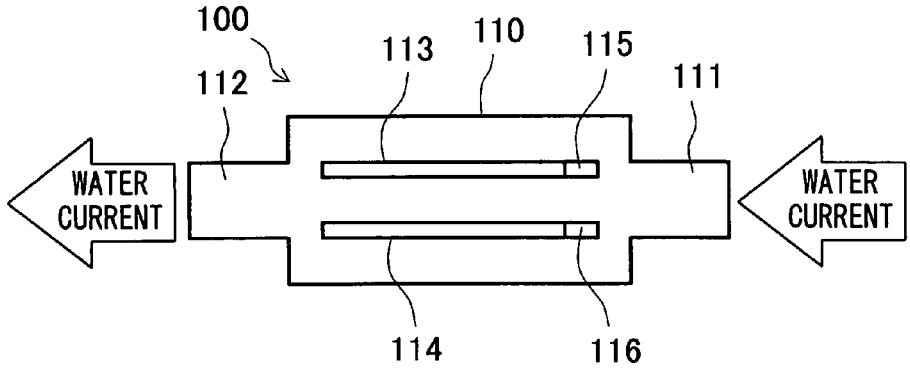
[FIG. 4] A schematic horizontal cross-sectional view of an ion elution unit.
Figure 5:
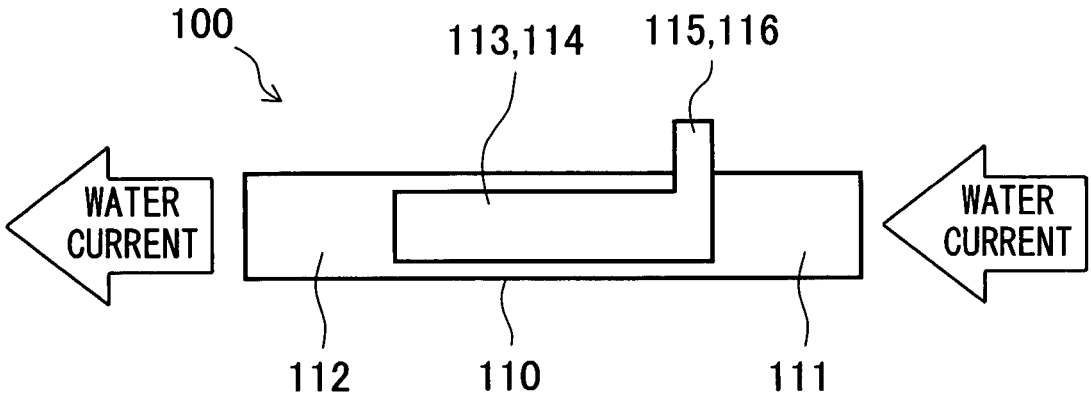
[FIG. 5] A schematic vertical cross-sectional view of the ion elution unit.

FIGS. 4 and 5 are schematic cross-sectional views of the ion elution unit 100, FIG. 4 being a horizontal cross-sectional view and FIG. 5 being a vertical cross-sectional view. The ion elution unit 100 has a case 110 formed of an insulating material such as synthetic resin. The case 110 has a water inlet 111 at one end and a water outlet 112 at the other end. Inside the case 110, two plate-shaped electrodes 113 and 114 are arranged parallel to and at a predetermined distance from each other. The electrodes 113 and 114 are formed of a material containing a metal, such as silver, copper, or zinc, from which metal ions exerting an antibacterial effect can be generated.

The electrodes 113 and 114 are, at one end, provided with terminals 115 and 116 respectively. Preferably, the electrode 113 and the terminal 115 are formed integrally, and so are the electrode 114 and the terminal 116; in a case where that cannot be done, the joints between the electrodes and the terminals along with the parts of the terminals located inside the case 110 need to be coated with synthetic resin and thereby kept out of contact with water, in order to prevent electrolytic corrosion. The terminals 115 and 116 protrude out of the case 110, and are connected to a drive circuit 150 in a controller 90, which will be described later.

Inside the case 110, water flows parallel to the length direction of the electrodes 113 and 114. With water flowing inside the case 110, when a predetermined voltage is applied between the electrodes 113 and 114, metal ions are eluted from whichever of the electrodes 113 and 114 is functioning as an anode. The electrodes 113 and 114 are, for example, silver plates each approximately measuring 2 cm by 5 cm and 1 mm thick, and are arranged at a distance of 5 mm.

It is preferable that the metal of which the electrodes 113 and 114 are formed be silver, copper, zinc, or an alloy of these. These three metals all exert an antibacterial effect. Particularly effective in killing bacteria are silver ions eluted from silver electrodes and zinc ions eluted from zinc electrodes; particularly effective in preventing mold are copper ions eluted from copper electrodes. From an alloy of these metals, ions of the different metals composing it can be eluted simultaneously.

With the ion elution unit 100 constructed as described above, it is possible to choose whether to elute metal ions or not by choosing whether to apply a voltage or not. Moreover, it is possible to control the amount of eluted metal ions by controlling the current and the duration of application of the voltage. Thus, as distinct from methods whereby metal ions are eluted from a metal ion carrier such as zeolite, it is possible to electrically do all the necessary operations, namely the choice of whether to add metal ions or not and the adjustment of the concentration of metal ions, resulting in good usability.

In the top face of a front part of the cabinet 10, an operation panel 16 is provided. As shown in FIG. 1, on the operation panel 16 are arranged: a display section 81 including a liquid crystal display and a buzzer; and a switch section 82 including buttons via which various switches are operated.

Reference numeral 90 represents a controller built around a microprocessor. The controller 90 includes a storage device such as a hard disk, and thus also serves as storage means. The controller 90 is arranged inside the cabinet 10, close to the operation panel 16, and receives operation commands from the user via the switch section 82.

Figure 6:
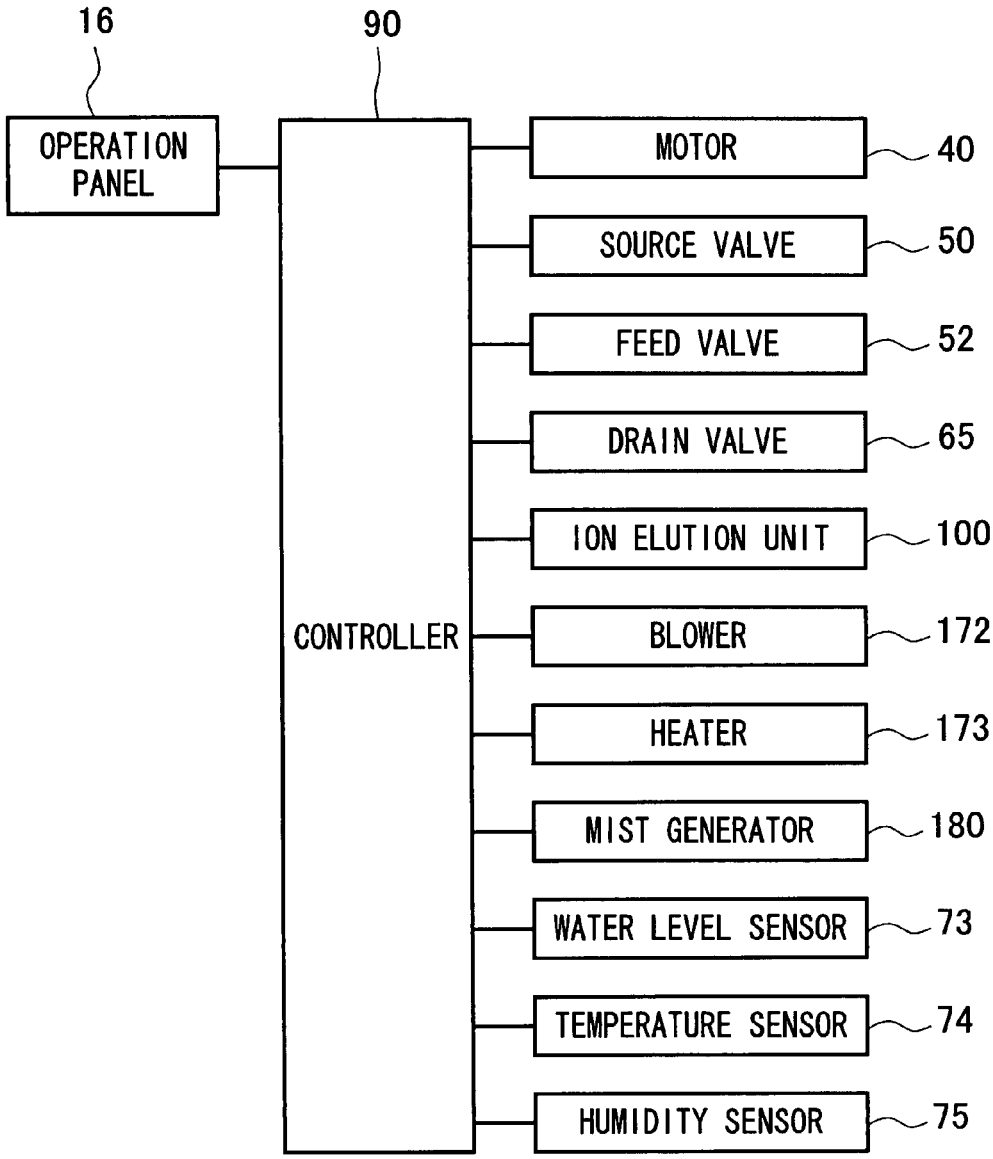
[FIG. 6] A control block diagram.

As shown in FIG. 6, the controller 90 is connected to the targets it controls, namely the motor 40, the source valve 50, the feed valve 52, the drain valve 65, the ion elution unit 100, the blower 172, the heater 173, and the mist generator 180. The controller 90 is also connected to detection means, namely the water level sensor 73, a temperature sensor 74, and a humidity sensor 75. The temperature sensor 74 and the humidity sensor 75 are for detecting the temperature and humidity inside the hermetic drying chamber 170.

The controller 90 includes the drive circuit for the ion elution unit 100. Now, with reference to FIG. 7, the configuration of the drive circuit 120 for the ion elution unit 100 will be described.

In the driving circuit 120, a transformer 122 is connected to commercially delivered electric power 121 to step down its voltage, 100V, down to a predetermined voltage. The output voltage of the transformer 122 is rectified by a full-wave rectification circuit 123, and is then turned into a constant voltage by a constant voltage circuit 124. To the constant voltage circuit 124, a constant current circuit 125 is connected. The constant current circuit 125 so operates as to feed a constant current to an electrode drive circuit 150, which will be described later, irrespective of variation in the resistance across the electrode drive circuit 150.

Also connected to the commercially delivered electric power 121, in parallel with the transformer 122, is a rectifying diode 126. The output voltage of the rectifying diode 126 is smoothed by a capacitor 127, is then formed into a constant voltage by a constant voltage circuit 128, and is then fed to a central controller 130. The central controller 130 controls the triggering of a triac 129 connected between the primary coil of the transformer 122 and the commercially delivered electric power 121.

Figure 7:
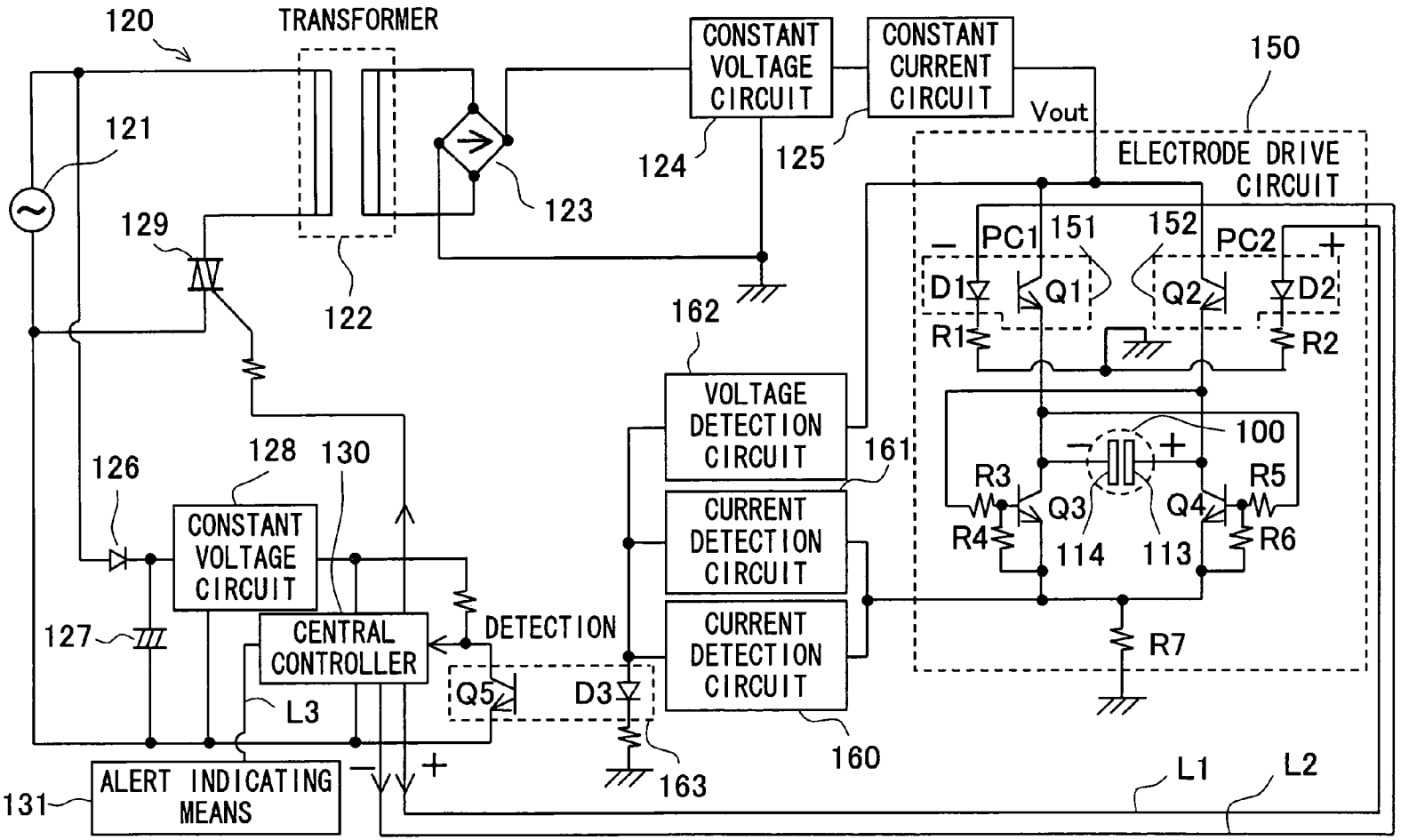
[FIG. 7] An ion elution unit drive circuit diagram.

An electrode drive circuit 150 is built with NPN-type transistors Q1 to Q4, diodes D1 and D2, and resistors R1 to R7 interconnected as shown in FIG. 7. The transistor Q1 and the diode D1 together constitute a photocoupler 151, and the transistor Q2 and the diode D2 together constitute a photocoupler 152; thus, the diodes D1 and D2 are photodiodes, and the transistors Q1 and Q2 are phototransistors.

Suppose now that the central controller 130 applies a voltage such that a high level is on a line L1 and a low level is on a line L2. This turns the diode D2 ON, and thus turns the transistor Q2 ON. With the transistor Q2 ON, a current flows through the resistors R3, R4, and R7, and applies a bias to the base of the transistor Q3, thereby turning the transistor Q3 ON.

On the other hand, since the diode D1 is OFF, the transistor Q1 is OFF, and thus the transistor Q4 too is OFF. In this state, a current flows from the electrode 113, now serving as an anode, to the electrode 114, now serving as a cathode. Thus, inside the ion elution unit 100, metal ions are eluted from the anode.

If a current is passed through the ion elution unit 100 in one direction for a long period, the anode-side electrode 113 wears, while impurities in the water deposit on the cathode-side electrode 114, forming scale that firmly adheres to it. Since this degrades the performance of the ion elution unit 100, to avoid it, the polarities of the electrodes are reversed cyclically.

To reverse the polarities of the electrodes, the central controller 130 is so switched as to reverse the voltages on the lines L1 and L2 so that a current flows in the reverse direction between the electrodes 113 and 114. In this state, the transistors Q1 and Q4 are ON, and the transistors Q2 and Q3 are OFF. The central controller 130 incorporates a counting function, and performs the above switching every time a predetermined count is reached. The counting function is realized, for example, by counting time. When the predetermined count is set at, for example, 20 seconds, the polarities of the electrodes are reversed every 20 seconds. In this way, the polarities of the electrodes can be reversed cyclically.

In case a variation in the resistance across the electrode drive circuit 150, in particular a variation in the resistance between the electrodes 113 and 114, causes a fault such as a decrease in the current flowing between the electrodes, the constant current circuit 125 raises its output voltage to compensate for the decrease in the current. As the total duration of use extends, however, the electrodes eventually wear so much that the ion elution unit 100 comes to an end of its useful life and the decrease in the current can no longer be compensated for with an increase in the output voltage of the constant current circuit 125.

To cope with this, in the electrode drive circuit 150, the current flowing between the electrodes 113 and 114 of the ion elution unit 100 is monitored by monitoring the voltage across the resistor R7, and, when the current becomes equal to a predetermined minimum current level, a current detection circuit 160 detects it. The information that the minimum current level is detected is transmitted via a diode D3 and a transistor Q5, which together constitute a photocoupler 163, to the central controller 130. The central controller 130 then drives, via a line L3, an alert indicating means 131 to make a predetermined alert indication. The alert indicating means 131 is arranged in the display section 81.

In addition, to cope with faults such as short-circuiting in the electrode drive circuit 150, a current detection circuit 161 is provided for detecting the current being above a predetermined maximum current level. Based on the output of the current detection circuit 161, the central controller 130 drives the alert indicating means 131. Furthermore, when the output voltage of the constant current circuit 125 becomes below a predetermined minimum level, a voltage detection circuit 162 detects it, and likewise the central controller 130 drives the alert indicating means 131.

Now, the operation of the washer-dryer 1 will be described. The door 12 is opened, and laundry is placed in the drum 30. Detergent is put in the detergent compartment in the water-spout 53, and, as necessary, a treatment agent is put in the treatment agent compartment. A treatment agent may be put in the course of a washing sequence.

After the detergent is put, the door 12 is closed, and the buttons on the switch section 82 are operated to select washing conditions. Last, a start button is pressed to start a washing sequence according to the flow charts in FIGS. 8 to 11.

Figure 8:
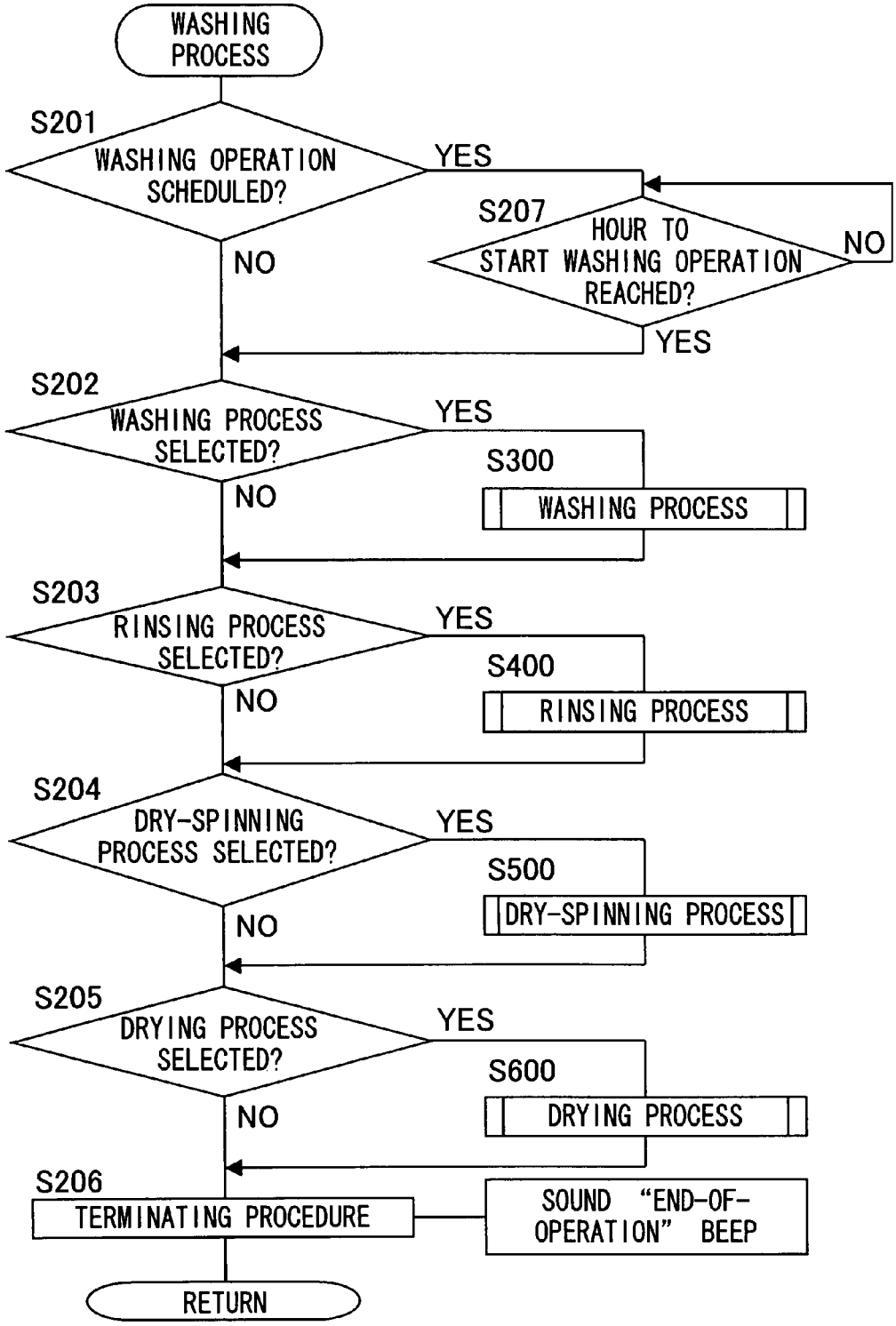
[FIG. 8] A flow chart of an entire washing sequence.

FIG. 8 is a flow chart showing the entire washing sequence. In step S201, whether or not a scheduled washing operation is set, that is, whether or not a washing operation is scheduled to start at a preset hour is checked. If a scheduled washing operation is set, an advance is made to step S207; if not an advance is made to step S202.

If an advance is made to step S207, whether or not the preset hour to start the scheduled washing operation is reached is checked. When the hour is reached, an advance is made to step S202.

In step S202, whether or not a washing process is selected is checked. If a washing process is selected, an advance is made to step S300. What is performed in the washing process in step S300 will be described later with reference to the separate flow chart in FIG. 9. On completion of the washing process, an advance is made to step S203. If no washing process is selected, an advance is made directly from step S202 to step S203.

In step S203, whether or not a rinsing process is selected is checked. If a rinsing process is selected, an advance is made to step S400. What is performed in the rinsing process in step S400 will be described later with reference to the separate flow chart in FIG. 10. On completion of the rinsing process, an advance is made to step S204. If no rinsing process is selected, an advance is made directly from step S203 to step S204.

In step S204, whether or not a spin-drying process is selected is checked. If a spin-drying process is selected, an advance is made to step S500. What is performed in the spin-drying process in step S500 will be described later with reference to the separate flow chart in FIG. 11. On completion of the spin-drying process, an advance is made to step S205. If no spin-drying process is selected, an advance is made directly from step S204 to step S205.

In step S205, whether or not a drying process is selected is checked. If a drying process is selected, an advance is made to step S600. What is performed in the drying process in step S600 will be described later with reference to the separate flow chart in FIG. 12. On completion of the drying process, an advance is made to step S206. If no drying process is selected, an advance is made directly from step S205 to step S206.

In step S206, a procedure for terminating the operation of the controller 90, in particular the processing unit (microprocessor) included in it, proceeds automatically. In addition, an "end-of-operation" beep or the like is sounded to indicate the completion of the washing sequence. On completion of the entire operations, the washer-dryer 1 returns to a stand-by state, ready for the next washing sequence.

Figure 9:
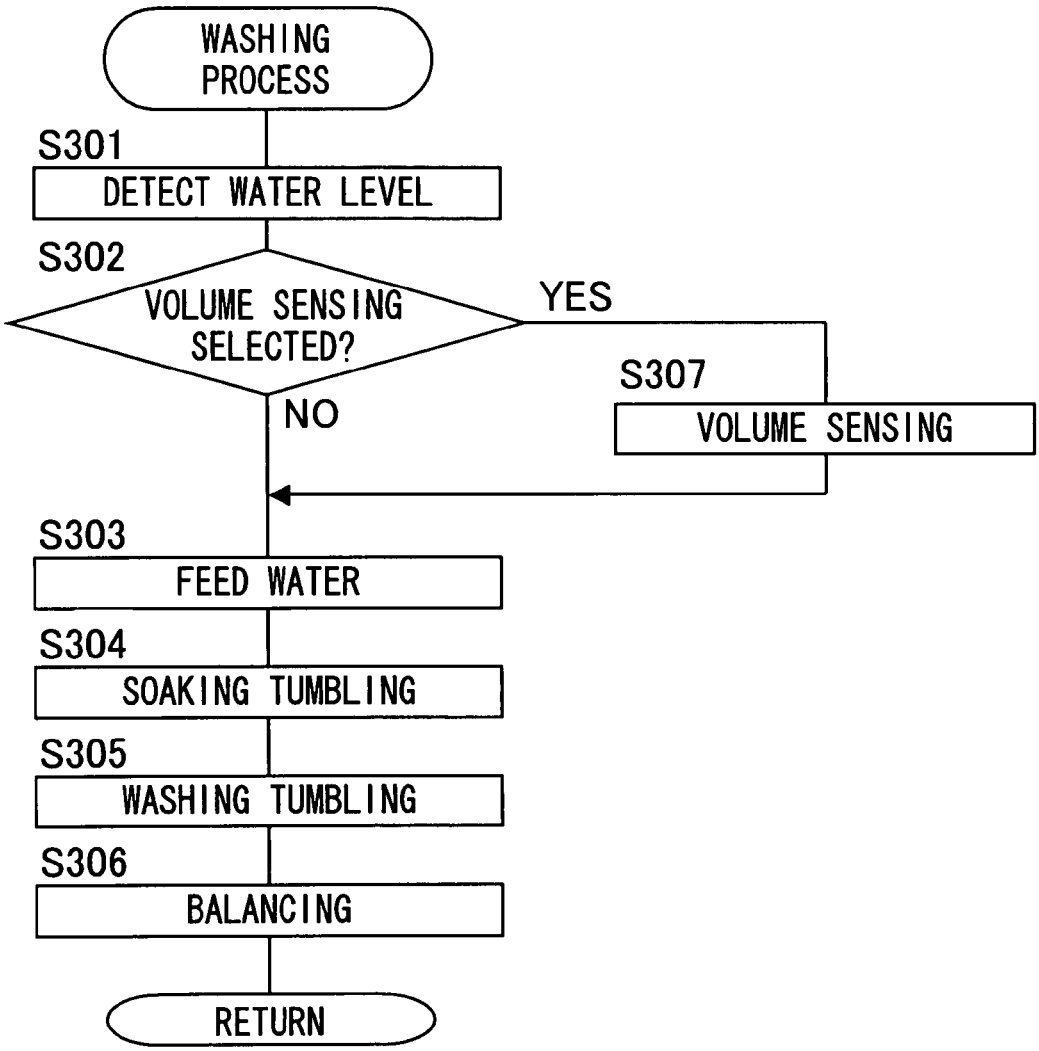
[FIG. 9] A flow chart of a washing process.

Next, with reference to FIGS. 9 to 12, what is performed in the washing, rinsing, spin-drying, and drying processes will be described one by one. FIG. 9 shows a flow chart of the washing process. In step S301, the water level inside the drum 30 as detected by the water level sensor 73 is read. In step S302, whether or not volume sensing is selected is checked. If volume sensing is selected, an advance is made to step S307; if no volume sensing is selected, an advance is made directly from step S302 to step S303.

In step S307, the volume of the laundry is measured based on the rotation load of the drum 30. After the volume sensing, an advance is made to step S303.

In step S303, the source valve 50 is opened, and also the port of the triple feed valve 52 feeding water to the detergent compartment in the waterspout 53 is opened, so that water is poured through the waterspout 53 into the drum 30 (put more precisely, water is poured into the tub 20, and the water enters the drum 30 through the water discharge holes 33). The detergent in the detergent compartment is thus fed, in a form mixed with water, into the drum 30. The drain valve 65 remains closed. When the water level sensor 73 detects that the water level has reached the preset level, the main feed valve 50*a* is closed. Then, an advance is made to step S304.

In step S304, soaking tumbling is performed. The drum 30 is rotated at low speed so as to repeatedly take the laundry out of water and then let it drop back into water. This makes the laundry soak up plenty of water, and make the air trapped in the laundry escape.

After the soaking tumbling, an advance is made to step S305. In step S305, the drum 30 is rotated with a pattern of tumbling for washing so as to repeatedly lift the laundry high and then let it drop. Here, the impact that the laundry receives when it drops causes water to jet through its fabric, and thereby achieves the washing of the laundry.

On completion of the washing tumbling, an advance is made to step S306 to perform balancing. In step S306, the drum 30 is rotated slowly. When the drum 30 is rotated slowly, before the laundry is lifted high, it comes off the drum 30 and drops. If the laundry drops from a high level, it crashes against the inner wall of the drum 30, and thus sticks fast to it. This makes it difficult to establish a balanced weight distribution when the drum 30 starts to rotate at high speed for spin-drying. By contrast, letting the laundry come off the inner wall of the drum 30 at a low level allows the laundry to roll rather than crash, and thus helps keep the laundry loose. This makes it easy for the laundry to spread in all directions as soon as the drum 30 starts to rotate at high speed for spin-drying; that is, it is easy to establish a balanced weight distribution. Thus, the drum 30 is rotated slowly to loosen the laundry in preparation for spin-drying.

Figure 10:
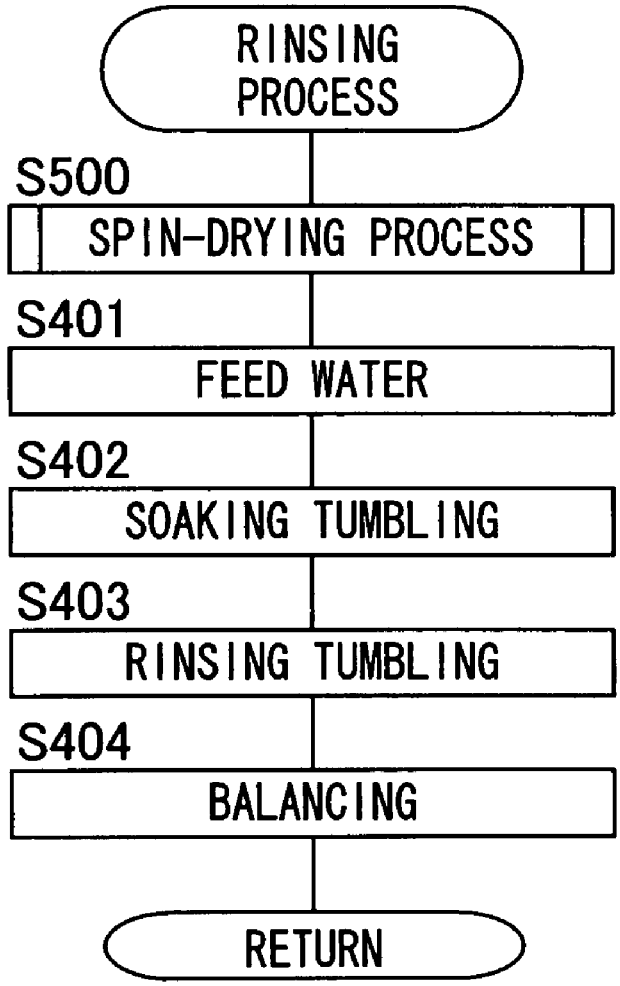
[FIG. 10] A flow chart of a rinsing process.

Next, with reference to the flow chart in FIG. 10, what is performed in the rinsing process will be described. First, in step S500, a spin-drying process is performed; what is performed here will be described later with reference to the flow chart in FIG. 11. After the spin-drying, an advance is made to step S40 1. In step S401, the source valve 50 is opened, and also the port of the triple feed valve 52 feeding water to the detergent compartment in the waterspout 53 is opened, so that water is fed until its level reaches the preset level.

After the feeding of water, an advance is made to step S402. In step S402, soaking tumbling is performed. The soaking tumbling here is the same as that performed in step S304 in the washing process.

After the soaking tumbling, an advance is made to step to step S304. According to the conditions selected by the user, the drum 30 is rotated with a pattern of tumbling for rinsing. The drum 30 soaks the laundry in water, and repeatedly lifts it to let it drop, thereby achieving the rinsing of the laundry.

In a case where the laundry is treated with a treatment agent, the port of the feed valve 52 feeding water to the treatment agent compartment in the waterspout 53 is opened at an appropriate time so that the treatment agent is fed into the rinsing water.

On completion of the rinsing tumbling, an advance is made to step S404 to perform balancing. In step S406, the drum 30 is rotated slowly to loosen the laundry in preparation for spin-drying.

The above description assumes the rinsing to be performed as "stored-water rinsing", that is, rinsing with water stored in the drum 30; it may instead be performed as "running-water rinsing", that is, rinsing with fresh water constantly fed, or as "shower rinsing", that is, rinsing with a shower of water sprayed on the laundry.

Figure 11:
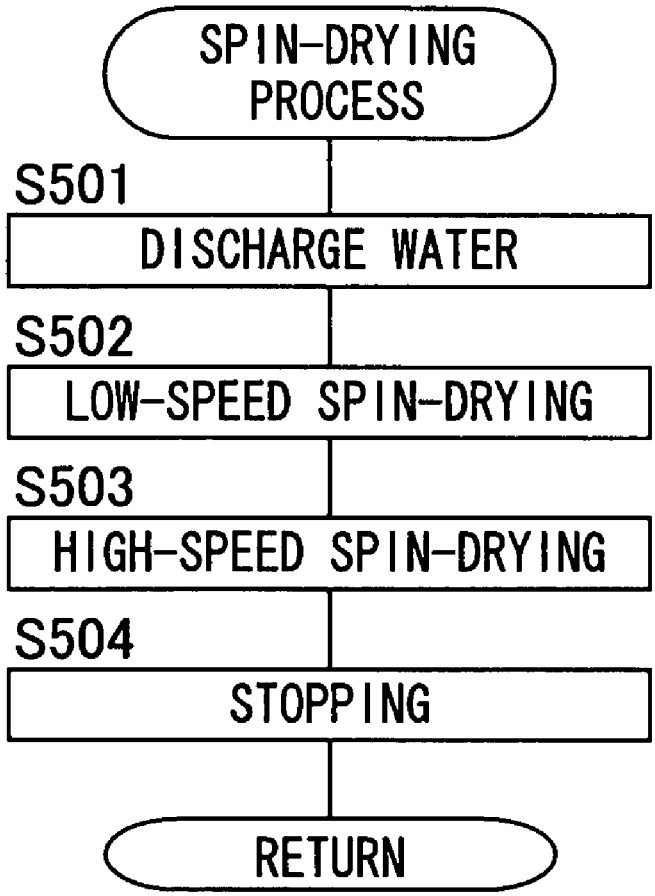
[FIG. 11] A flow chart of a spin-drying process.

Next, with reference to the flow chart in FIG. 11, what is performed in the spin-drying process will be described. First, in step S501, the drain valve 65 is opened. The washing or rinsing water in the drum 30 is discharged through the drain valve 65. The drain valve 65 remains open during the spin-drying process.

A predetermined period thereafter, when a large part of the water contained in the laundry has escaped out of it, an advance is made to step S502. In step S502, the tub 20 is rotated at comparatively low speed so that water is lightly spun out of the laundry.

As the drum 30 rotates, the laundry is pressed onto the inner circumferential wall of the drum 30 by a centrifugal force. The water contained in the laundry is thus collected on the inner circumferential face of the drum 30, and is then discharged through the water discharge holes 33. Having left the water discharge holes 33, the washing water hits the inner face of the tub 20, and then flow along the inner face of the tub 20 down to the bottom of the tub 20. The water then flows through the drain port 23, the drain pipe 60, the filter casing 61, the drain pipe 64, and the drain valve 65 so as to be discharged out of the cabinet 10.

After the low-speed spin-drying, an advance is made to step S503. In step S503, the drum 30 is rotated at high speed. The water contained in the laundry is mostly spun out of it. Then, an advance is made to step S504. In step S504, the motor 40 is de-energized to let the drum 30 rotate by inertia until it spontaneously comes to a halt.

Figure 12:
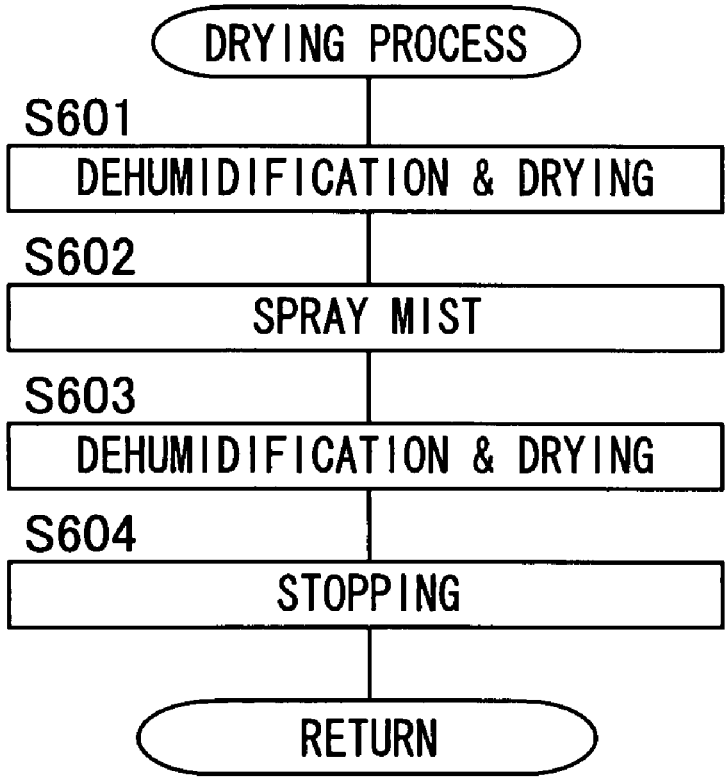
[FIG. 12] A flow chart of a drying process.

Next, with reference to the flow chart in FIG. 12, what is performed in the drying process will be described. In step S601, the drum 30 is rotated at low speed, and the blower 172 and the heater 173 are energized. The blower 172 produces a circulation air stream that circulates through the hermetic drying chamber 170 and the circulation duct 171. The heater 173 heats the circulation air stream. While being tumbled, the laundry is exposed to hot wind of the circulation air stream, and is thereby deprived of moisture.

The controller 90 monitors the results of detection by the temperature sensor 74 and the humidity sensor 75 to make the mist generator 180 spray dehumidification water at an appropriate time (e.g., when the temperature and humidity of the circulation air stream in the circulation duct 171 become higher than predetermined levels, which are preferably determined through experiments). Although the dehumidification water has passed through the ion elution unit 100, it is fresh water at this point because the ion elution unit 100 is not yet operating. As described earlier, the dehumidification water is sprayed in comparatively large drops, and thus the water drops fall without being blown toward the blower 172 by the circulation air stream. When the falling water drops make contact with the circulation air stream, the temperature of the circulation air stream falls, condensing the moisture in the circulation air stream. The condensed moisture mixes with the dehumidification water and flows down the circulation duct 171 to enter the tub 20, to be eventually discharged through the drain port 23.

In the latter half of the drying process, when the laundry has been considerably dried (this is recognized based on the temperature and humidity of the circulation air stream in the circulation duct 171, and when to recognize it is preferably determined through experiments), an advance is made to step S602. In step S602, the controller 90 makes the driving circuit 120 operate to make the ion elution unit 100 elute metal ions. Simultaneously, the controller 90 makes the mist generator 180 operate in a mist generating mode to turn the metal ion water fed from the ion elution unit 100 into a fine mist.

Since the mist containing metal ions is extremely fine, it does not fall against the circulation air stream but is carried by the circulation air stream to be sucked into the blower 172 and then blown out into the hermetic drying chamber 170. Although the mist passes by the heater 173, so long as its water drop size is adequate, it does not evaporate before reaching the laundry. Even if part of the mist evaporates before reaching the laundry and attaches in the form of fine particles of silver compounds to the laundry, no problem arises. The heater 173 may be kept OFF meanwhile.

The mist that has entered the hermetic drying chamber 170 by being carried by the circulation air stream is sprayed on the laundry. Thus, the metal ion water attaches, in the form of a fine mist, to the laundry. As a result, the metal ion water evaporates quickly, and leaves, on the laundry, crystals of metal compounds that are small in particle size and rich in lattice defects. Hence, next time these compounds make contact with moisture, metal ions are eluted quickly. Thus, it is possible to securely obtain the antibacterial effect of metal ions. Moreover, at this point, the laundry is not only considerably dried but also considerably hot. This, in combination with the fineness of the mist, allows the mist attached to the laundry to evaporate quickly. Thus, it is possible to produce crystals of metal compounds that are small in particle size and rich in lattice defects.

This tumbling of the laundry accompanied by the spraying of it with the mist containing metal ions is continued for a predetermined period, and then an advance is made to step S603. In step S603, the ion elution unit 100 is stopped from operating so that dehumidification with water containing no metal ions and drying with hot wind are performed again. Steps S602 and S603 may be performed once, or may be repeated any number of times. When, based on the results of detection by the temperature sensor 74 and the humidity sensor 75, the laundry is recognized to have been dried to a predetermined extent, an advance is made to step S604. In step S604, a stopping procedure similar to that in step S504 in the spin-drying process is performed.

The mist containing metal ions may be sprayed on the laundry after completion of the drying process, rather than during it.

Spraying the mist on the laundry that has been considerably dried helps prevent static electricity resulting from overdrying. Furthermore, since the mist absorbs heat of vaporization as it evaporates, it is possible to shorten the time needed for cooling after drying.

The metal ion water in the form of a mist that has attached to the surface of the laundry evaporates before ever flocking to form large drops. Thus, even if the surface of the laundry is water-repellent, it is unlikely that large drops of metal ion water that have flocked are repelled, and thus crystals of metal compounds can be left evenly on the surface of the laundry. Moreover, the metal ion water has only to attach, in the form of a mist, to the surface of the laundry, and does not have to penetrate the laundry. Thus, even if the surface of the laundry is hydrophobic, the metal ion water spreads over the entire laundry, and therefore a sufficient amount of metal compound crystals can be deposited on the surface of the laundry. Moreover, making the metal ion water into a mist allows the amount of metal compound crystals attached to be affected less by the surface of the laundry. Thus, increasing the metal ion concentration in the metal ion water does not lead to deposition of an excessive amount of metal compound crystals on the surface of highly absorbent laundry.

Furthermore, since the mist containing metal ions is confined inside the hermetic drying chamber 170, it does not occur that the mist containing metal ions leaks out of the washer-dryer 1 without duly attaching to the laundry. Thus, it is possible to make an effective use of the generated metal ions without wasting them. In addition, it does not occur that the mist that has leaked out of the washer-dryer 1 causes current leakage in the washer-dryer 1 itself or in an electric appliance nearby or increases the humidity around to cause mold to form.

Moreover, when the door 12 is closed, the washer-dryer 1 is almost completely air-tight. Thus, water remaining in the exhaust passage and elsewhere tends to keep the interior of the drum 30 humid, possibly leading to proliferation of bacteria and mold. In this embodiment, the mist containing metal ions spreads around the drum 30 and the tub 20 and attaches to their wall surfaces and the like. Thus, not only the laundry but also almost the entire space inside the washer-dryer 1 is treated by antibacterial treatment so as to suppress proliferation of bacteria and mold there.

The medium to which metal ions are added is not limited to water, and may be any other liquid. Using a volatile liquid such as alcohol allows quicker evaporation, and thus helps produce crystals of metal compounds that are smaller in particles size and rich in lattice defects. The liquid may be a mixture of water and alcohol, or may be a volatile solvent such as perchloroethylene.

The generation of a mist containing metal ions may be performed not only in the drying process but also in the washing, rinsing, and spin-drying processes. In that case, the metal ions attach to the laundry in the course of its washing, rinsing, and spin-drying. Spraying the mist on the laundry in the middle of being rotated at high speed for spin-drying allows the mist to penetrate the laundry under a centrifugal force, and thus allows the metal ions to attach effectively to the laundry. In the washing and rinsing processes, the metal ions can be eluted into the water itself with which washing and rinsing are performed.

Figure 13:
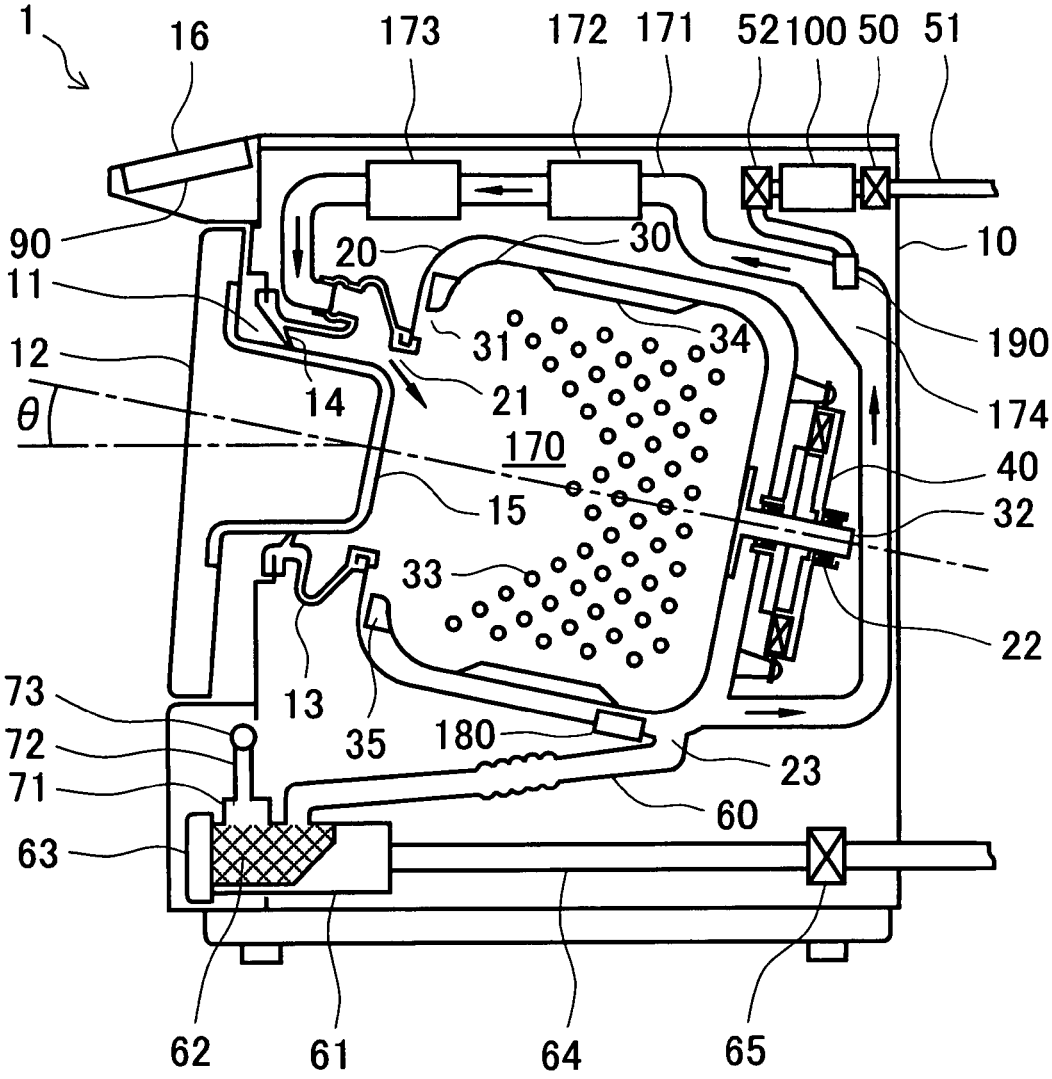
[FIG. 13] A vertical cross-sectional view of a dryer according to a second embodiment of the present invention.

The mist generator 180 is not limited to one that exploits the energy of an ultrasonic or sonic wave; it may be one that generates a mist by jetting out water and making it collide with something; it may be one that sucks up water by the Venturi effect to make it into a mist; or it may be one that utilizes a shower nozzle or spray nozzle. In short, the mist generator 180 has simply to make water into fine water drops FIG. 13 shows a second embodiment of the present invention. FIG. 13 is a vertical cross-sectional view, similar to FIG. 3, of a dryer. In regard to the second embodiment, such components as find their counterparts in the first embodiment are identified by the same reference numerals as those used in the description of the first embodiment, and their explanations will not be repeated. This applies also to the third and following embodiments.

In the second embodiment, a dehumidification water jet nozzle 190 for jetting out dehumidification water is provided separate from the mist generator 180. The dehumidification water jet nozzle 190 is housed inside the cooling chamber, and is fed with water from the third output port of the triple feed valve 52. The mist generator 180 is arranged at the bottom of the tub 20. The mist generator 180 makes the water fed form the waterspout 53 into a mist by exploiting the energy of an ultrasonic or sonic wave. The mist may be sprayed on the laundry inside the drum 30 through the water discharge holes 33 or through the circulation duct 171.

Figure 14:
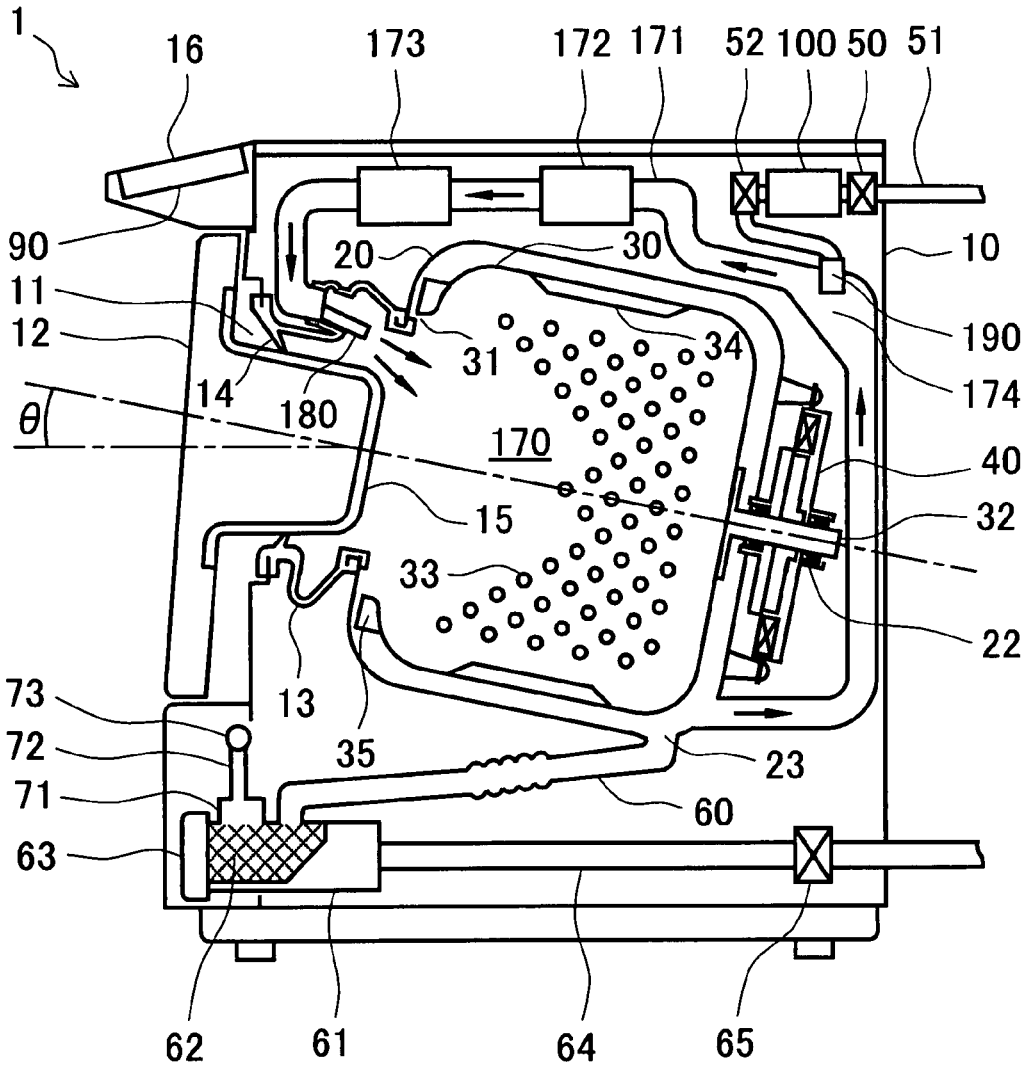
[FIG. 14] A vertical cross-sectional view of a dryer according to a third embodiment of the present invention.

FIG. 14 shows a third embodiment of the present invention. FIG. 14 is a vertical cross-sectional view, similar to FIG. 3, of a dryer.

Also in the third embodiment, as in the second embodiment, the dehumidification water jet nozzle 190 and the mist generator 180 are provided separate; here, however, the mist generator 180 is arranged in a position different from where it is arranged in the second embodiment. Specifically, the mist generator 180 is arranged in a position where it can jet the mist directly onto the laundry (in this embodiment, at the exit of the circulation duct 171. This arrangement allows the sprayed mist to attach efficiently to the laundry. Using directional spraying means such as a shower nozzle or spray nozzle makes it possible to spray the mist on the laundry more efficiently.

Figure 15:
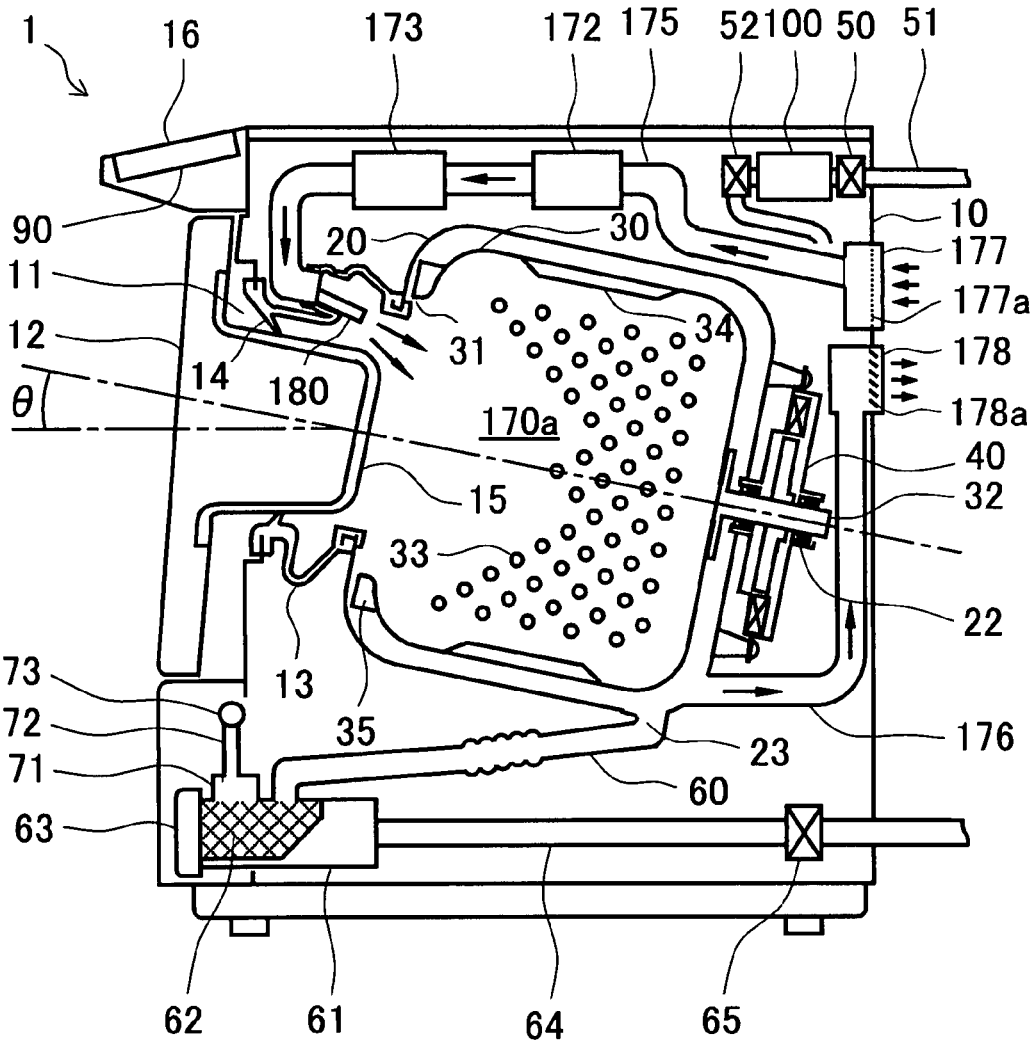
[FIG. 15] A vertical cross-sectional view of a dryer according to a fourth embodiment of the present invention.

FIG. 15 shows a fourth embodiment of the present invention. FIG. 15 is a vertical cross-sectional view, similar to FIG. 3, of a dryer.

What characterizes the fourth embodiment is that it has a drying chamber 170*a* that is open to outside air through an outside air introducer and an exhauster. Provided as the outside air introducer and the exhauster are an outside air introduction duct 175 through which outside air is introduced into the drying chamber 170*a* and an exhaust duct 176 through which the air inside the drying chamber 170*a* is exhausted. Midway along the outside air introduction duct 175, the blower 172 and the heater 173 are provided. Outside air is sucked in through an outside air introduction port 177 in the back of the cabinet 10, and is then heated by the heater 173 to become hot wind, which is then blown into the drying chamber 170*a* through the top part of the door gasket 13. The exhaust duct 176 has its entrance near the drain port 23 of the tub 20 so that there the air inside the drying chamber 170*a* flows into the exhaust duct 176 so as to be exhausted through an exhaust port 178 provided in the back of the cabinet 10. As in the third embodiment, the mist generator 180 is arranged in a position where it can jet the mist directly onto the laundry (in this embodiment, at the exit of the circulation duct 171).

The outside air introduction port 177 is provided with a filter 177*a* for preventing entry of dust. The exhaust port 178 is provided with a louver 178*a* for restricting the direction in which the exhausted air is blown out. The outside air introduction port 177 and the exhaust port 178 are arranged at a level higher than the highest possible water level inside the tub 20.

In the drying process, while the drum 30 is rotated at low speed, the blower 172 and the heater 173 are energized so that outside air is made into hot wind and is then fed into the drying chamber 170*a*. The hot wind having deprived the laundry of moisture is exhausted through the exhaust port 178.

In the latter half of the drying process and/or after completion of the drying process, a mist containing metal ions is blown out from the mist generator 180 so as to be sprayed on the laundry. The mist containing metal ions is sprayed on the laundry that has been considerably or completely dried. At this stage, the laundry is considerably hot, and therefore the mist evaporates quickly. The high evaporation speed here makes it possible to produce crystals of metal compounds that are smaller in particle size and richer in lattice defects.

Moreover, attaching the mist to the considerably dried laundry helps prevent static electricity caused by overdrying. Furthermore, since the mist absorbs heat of vaporization as it evaporates, it is possible to shorten the time needed for cooling after drying.

The fourth embodiment adopts an open drying system in which outside air is introduced into the drying chamber 170*a* and the air inside the drying chamber 170*a* is exhausted. This offers good drying efficiency, and allows quick evaporation of the metal ion water in the form of a mist that has attached to the laundry. Thus, it is possible to efficiently deposit crystals of metal compounds rich in lattice defects.

The present invention may be practiced in any manner other than specifically described by way of embodiments above, and many variations and modifications are possible within the scope and spirit of the invention. For example, the present invention finds application not only in washier-driers as dealt with in the embodiments but also in cleaner-dryers equipped with both cleaning and drying functions, and in dryers equipped simply with a drying function; it finds application not only in clothes dryers but also in tableware dryers and hand dryers.

INDUSTRIAL APPLICABILITY

The present invention finds wide application in dryers.

What is claimed is:

1. A dryer comprising:

a drying chamber for accommodating an article-to-be-dried;

heating means for heating air inside the drying chamber to heat the drying chamber;

eluting means for eluting metal ions into water;

feeding means for feeding the drying chamber with fine water drops of the water;

detecting means for detecting that the article-to-be-dried has dried; and a control unit that controls the eluting means and the feeding means to feed the fine water drops containing eluted metal ions to the drying chamber when the detecting means detects that the article-to-be-dried has dried, such that the fine water drops that have attached to the article-to-be-dried are evaporated with heat of the article-to-be-dried heated.

2. A dryer comprising:

a drying chamber for accommodating an article-to-be-dried;

heating means for heating air inside the drying chamber to heat the drying chamber;

eluting means for eluting metal ions into water;

feeding means for feeding the drying chamber with fine water drops of the water; and detecting means for detecting that the article-to-be-dried has dried; and a control unit that controls the eluting means and the feeding means to feed the fine water drops containing eluted metal ions to the drying chamber when the detecting means detects that the article-to-be-dried has dried, thereby crystals of metal compounds having lattice defects are produced on a surface of the article-to-be-dried.

3. A dryer comprising:

a drying chamber for accommodating an article-to-be-dried;

driving means for rotating the drying chamber;

heating means for heating air inside the drying chamber to heat the drying chamber;

eluting means for eluting metal ions into water; and feeding means for the drying chamber with fine water drops of the water; and detecting means for detecting that the article-to-be-dried has dried; and a control unit that controls the eluting means and the feeding means to feed the fine water drops containing eluted metal ions to the drying chamber when the detecting means detects that the article-to-be-dried has dried, thereby crystals of metal compounds having lattice defects are produced on a surface of the article-to-be-dried.

4. A dryer comprising:

a drying chamber for accommodating an article-to-be-dried;

driving means for rotating the drying chamber;

heating means for heating air inside the drying chamber to heat the drying chamber;

eluting means for eluting silver ions into water; and feeding means for feeding the drying chamber with fine water drops of the water; and detecting means for detecting that the article-to-be-dried has dried; and a control unit that controls the eluting means and the feeding means to feed the fine water drops containing eluted silver ions to the drying chamber when the detecting means detects that the article-to-be-dried has dried, thereby crystals of silver compounds having lattice defects are produced on a surface of the article-to-be-dried.

5. The dryer according to any one of claims 1 to 4, further comprising:

dehumidifying means for dehumidifying the air inside the drying chamber.

6. The dryer according to claim 5, wherein the dehumidifying means achieves dehumidification by bringing the air inside the drying chamber into contact with dehumidification water, and the dehumidification water is sprayed by the feeding means.

7. The dryer according to any one of claims 1 to 4, further comprising one or both of:

an outside air introducer for introducing outside air into the drying chamber; and an exhauster for exhausting the air inside the drying chamber.

8. The dryer according to any one of claims 1 to 3, wherein the control unit controls the generation of the fine water drops containing the metal ions and feeding of the fine water drops to the article-to-be-dried are performed in a latter half of a drying process and/or after completion of the drying process.

9. The dryer according to any one of claims 1 to 4, wherein the feeding means is arranged in a position where the feeding means sprays the fine water drops directly on the article-to-be-dried.

10. The dryer according to any one of claims 1 to 4, wherein the feeding means generates the fine water drops by exploiting energy of an ultrasonic or sonic wave.

11. The dryer according to any one of claims 1 to 4, wherein the detecting means detects that the article-to-be-dried has dried based at least on one of temperature and humidity of the heated air circulating inside the drying chamber.

* * * * *